US006208969B1

(12) United States Patent
Curtin

(10) Patent No.: US 6,208,969 B1
(45) Date of Patent: Mar. 27, 2001

(54) ELECTRONIC DATA PROCESSING APPARATUS AND METHOD FOR SOUND SYNTHESIS USING TRANSFER FUNCTIONS OF SOUND SAMPLES

(75) Inventor: Steven DeArmond Curtin, Freehold, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/122,520

(22) Filed: Jul. 24, 1998

(51) Int. Cl.[7] ..... G10L 13/02

(52) U.S. Cl. ..... 704/264; 704/265; 704/258

(58) Field of Search ..... 704/258, 200, 704/201, 500, 212, 220, 203, 205, 206, 226, 227, 228, 260, 264, 265, 263

(56) References Cited

U.S. PATENT DOCUMENTS

| | | | | |
|---|---|---|---|---|
| 4,393,272 | * | 7/1983 | Itakura et al. | 704/269 |
| 4,395,931 | | 8/1983 | Wachi | 84/1.21 |
| 4,604,935 | * | 8/1986 | Cooper | 84/600 |
| 4,776,014 | | 10/1988 | Zinser, Jr. | 381/38 |
| 4,797,929 | | 1/1989 | Gerson et al. | 381/43 |
| 4,868,869 | * | 9/1989 | Kramer | 381/61 |
| 4,905,288 | | 2/1990 | Gerson et al. | 381/43 |
| 4,991,218 | * | 2/1991 | Kramer | 381/61 |
| 5,133,010 | | 7/1992 | Borth et al. | 381/38 |
| 5,412,152 | | 5/1995 | Kagayama et al. | 84/607 |
| 5,479,562 | | 12/1995 | Fielder et al. | 395/2.38 |
| 5,504,833 | * | 4/1996 | George et al. | 704/211 |
| 5,536,902 | | 7/1996 | Serra et al. | 84/623 |
| 5,596,330 | | 1/1997 | Yokev et al. | 342/387 |
| 5,604,893 | | 2/1997 | Burnett et al. | 395/500 |
| 5,619,002 | | 4/1997 | Walck | 84/603 |
| 5,621,854 | | 4/1997 | Hollier | 395/2.37 |
| 5,627,334 | * | 5/1997 | Hirano et al. | 84/623 |
| 5,627,899 | | 5/1997 | Craven et al. | 381/98 |
| 5,630,011 | | 5/1997 | Lim et al. | 395/2.14 |
| 5,630,012 | | 5/1997 | Nishuguchi et al. | 395/2.17 |
| 5,633,983 | | 5/1997 | Coker | 395/2.69 |
| 5,748,747 | * | 5/1998 | Massie | 381/61 |
| 5,771,299 | * | 6/1998 | Melanson | 381/316 |
| 5,905,221 | * | 5/1999 | Deforeit | 84/622 |

OTHER PUBLICATIONS

Proc. 1999 IEEE Workshop on applications of signal processing to audio and acoustics. Trautmann et al., "Digital sound–synthesis bases on transfer function models". OCt. 17–20, 1999.*

H. Chamberlain, Musical Applications of Microprocessors, 1980, pp. 387–389, Hayden Book Company Inc., Rochelle Park, New Jersey.

F. R. Moore, "Nonlinear Synthesis", in Elements of Computer Music, date, p. 333–336.

(List continued on next page.)

*Primary Examiner*—Richemond Dorvil
(74) *Attorney, Agent, or Firm*—Wilford L. Wisner

(57) ABSTRACT

A method and an electronic data processing apparatus for wave synthesis that retains the true qualities of naturally occurring sounds, such as those of musical instruments, speech, or other sounds. Transfer functions representative of recorded sound samples are pre-calculated and stored for use in an interpolative process to generate a transfer function representative of the sound to be synthesized. The preferred transfer functions are Chebyshev polynomial-based transfer functions, which assure a highly predictable harmonic content of synthesized sound. Output sound generation is driven by time domain signals produced by reconversion of a sequence of interpolated transfer functions. Non-harmonic sounds are synthesized using multiple frequency inputs to the reconverting (waveshaping) stage, or by parallel waveshaping stages. Speech sibilants and noise envelopes of instruments are synthesized by the input of noise into the waveshaping stage by modulation of a sinusoid with band-limited noise.

27 Claims, 9 Drawing Sheets

OTHER PUBLICATIONS

M. Le Brun, "Digital Waveshaping Synthesis", in J. Audio Eng. Soc., vol. 27, Apr. 1979, pp. 250–266.

Dodge and Jerse, "Synthesis Using Distortion Techniques", in Computer Music, 1985, pp. 128–137.

J. Beauchamp, "A Computer System for Time–variant Harmonic Analysis and Synthesis of Musical Tones", in Music By Computers, 1969, pp. 19–61, (John Wiley and Sons, New York).

D. Arfib, "Digital Synthesis of Complex Spectra by Means of Multiplication of Nonlinear Distorted Sine Waves", J. Audio Eng. Soc., Oct. 1979, pp. 757–768.

J. Beauchamp et al., "Extended Nonlinear Waevedshaping Analysis/Synthesis Technique Tones", in Proc. Computer Music Conference, Oct. 14–18, 1992, pp. 2–5, San Jose, Cal.

* cited by examiner

WAVESHAPER TRANSFER FUNCTION LOOKUP PROCESS

INTERPOLATING WAVESHAPER

TRANSFER FUNCTION SEQUENCE INTERPOLATOR SYSTEM

INTERPOLATION BLOCK

SINE FREQUENCY SOURCE

ANALYTICAL WAVESHAPER INPUT-OUTPUT COMPARISON

ELECTRONIC DATA PROCESSING APPARATUS AND METHOD FOR SOUND SYNTHESIS USING TRANSFER FUNCTIONS OF SOUND SAMPLES

BACKGROUND OF THE INVENTION

1. Field of the Invention

This invention relates to an electronic data processing system and method for sound synthesis using sound samples, and particularly to such a system or method using transfer functions.

2. Discussion of the Related Art

Most conventional electronic musical instruments use so-called wavesamples of actual musical instruments as building blocks for synthesizing simulations of the instruments that sound realistic. The electronic instruments must switch or fade between multiple time-domain sample waves, which must be sufficiently numerous to encompass an entire keyboard and to provide adaptability for various rates of sound change. The resulting stored sample sets have sizes in the megabyte range.

Alternatives for avoiding the large amount of data in sampled sets include physical modeling or additive synthesis. Additive synthesis can, for example, interpolate very simply between loud and soft sounds for a sound in between. Nevertheless, such additive synthesis becomes prohibitively expensive in its use of logic because of the addition of many sinusoids (up to 64 per voice) and the complexity of controlling the amplitudes of the constituent sinusoids.

SUMMARY OF THE INVENTION

The invention is based on the recognition that the best of both worlds of sampling and synthesis can be obtained.

According to one aspect of the invention, a method of additive sound synthesis includes the computer-based steps of reading stored data that include transfer functions representing harmonic data derived from recorded sounds, and combining the read transfer functions to interpolate between them. These steps produce a resultant transfer function that corresponds to a sound spectrally interpolated between the harmonic data. The computer converts the resultant transfer functions to time domain signals, and peripheral apparatus generates sound from the time domain signals.

According to a preferred implementation of the method of the invention, transfer functions to be combined are read in respective first and second processes. Preferably, the stored transfer functions include Chebyshev polynomial-based transfer functions. Advantageously, when the transfer functions in the first and second processes represent harmonic data having different timbre, the method yields timbre morphing.

Further, according to a related feature of the invention, anharmonic spectra are generated. To a plurality of parallel processes using the method of the invention is added the step of driving the reconversion of the transfer functions by sinusoids having frequencies that are not harmonically related.

According to another feature of the invention, the method operates very efficiently in real time because the transfer functions are prepared from the sound samples in advance of the real time application.

According to another feature of the method of the invention, useful in producing speech sibilants or noise envelopes of instruments, for example, selected noise spectra are supplied in the conversion step for modulating the base frequency of the driving sinusoid. Alternatively or in addition, according to this feature, a band-limited frequency modulation signal modulates the sinusoid that drives the conversion step.

According to a second aspect of the invention, an electronic data processing system for sound synthesis includes an electronic memory storing a plurality of frames of data that include sequences or collections of transfer functions representing harmonic data derived from recorded sounds. A transfer function reader reads from the memory the transfer functions and supplies them to apparatus for combining pairs of transfer functions for interpolation between them. Each of the pairs of transfer functions represent adjacent data points with respect to some parameter of the recorded sound samples. Therefore, the interpolated transfer function represents an interpolation with respect to that parameter of the recorded sound samples. Excitation apparatus converts the resultant transfer functions to time domain signals representative of the sound to be synthesized. A speaker or other transducer generates sound from the time domain signal.

According to a preferred implementation of the system of the invention, the transfer functions include Chebyshev polynomial-based transfer functions. Optionally, compression of the stored data may be obtained by storing those transfer functions as the pertinent polynomial coefficients only and regenerating the full transfer functions from the stored coefficients as needed by the interpolation process.

According to a feature of the system of the invention, related sequences of transfer functions or coefficients are read into parallel synthesis paths for interpolation between different sound qualities.

According to other features of the invention, the excitation apparatus supplies a plurality of driving sinusoids of selected frequency relationships, or band-limited noise modulation of a driving sinusoid that is also involved in the reading steps of the method. In one implementation, an external instrument or sound source for which the waveform has been filtered to a band close to its fundamental frequency could take the place of the excitation oscillator. Thereby, the external instrument or sound source could supply an excitation source for synthesizing the sound of another instrument.

BRIEF DESCRIPTION OF THE DRAWING

Further features and advantages according to the invention will be apparent from the following detailed description, taken together with the drawing, in which.

DETAILED DESCRIPTION

Figure 1A:
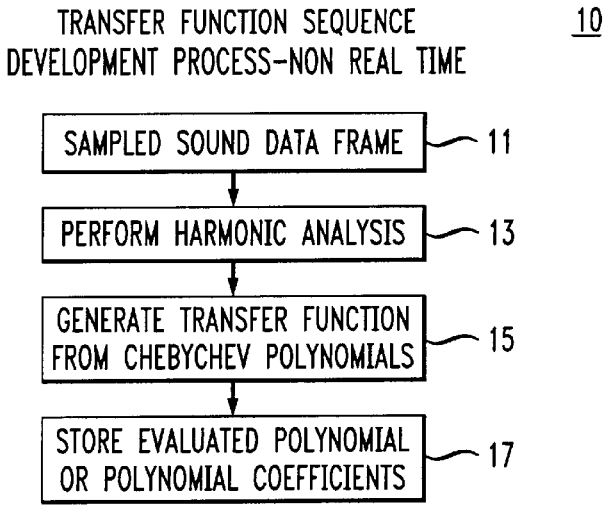
FIG. 1A shows a flow diagram of a preferred implementation of a non-real-time aspect of a method according to the invention.
Figure 1B:
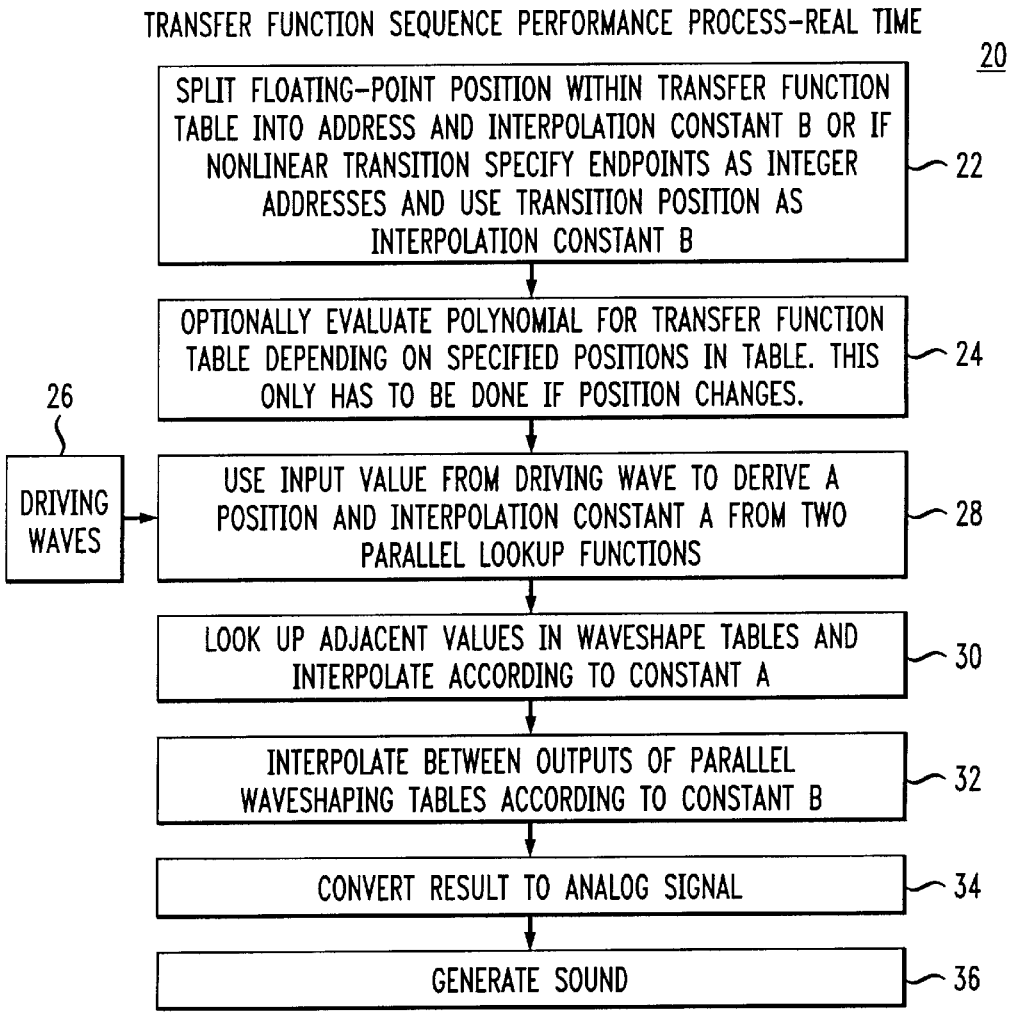
FIG. 1B shows a flow diagram of a preferred implementation of a real-time aspect of a method according to the invention.

The method shown in flow diagram form in FIGS. 1A and 1B provides frame-based additive synthesis via waveshaping with interpolated transfer function sequences derived from harmonic analysis of recorded sound. The method consists of two parts, the preparatory, or non-real-time, method 10 of FIG. 1A and the operational, or real-time, method 20 of FIG. 1B. One use of preparatory method 10, however, supplies starting material for many uses of operational method 20 according to the invention, possibly at different times or places.

In FIG. 1A, step 11 samples recorded sound, for example, a performance on a fine violin, piano, or saxophone, and provides a frame, or a sequence of frames, of digital sampling data. A sample, or frame, of recorded sound is shown, for example, in FIG. 7A, which is described hereinafter. Step 13 performs frequency analysis of each data frame to provide frame-based harmonic data. A frame of analysis signal spectrum is shown, for example, in FIG. 7B, described hereinafter. The techniques of steps 11 and 13 are well known. One implementation of sound sampling, per step 11, uses PCM, a conventional digital sampling technique that captures the analog input signal and converts it into a sequence of digital numbers. This technique is not exclusive of other sampling techniques. Various types of Fourier analysis, wavelet analysis, heterodyne analysis, and/or even hand editing may be used to generate the harmonic data per step 13. For non-real-time processing, a conventional processor in a general purpose computer, such as a personal computer, is preferred. While the following description refers mainly to musical instruments, references to human speech in all its forms, or other sounds, could be substituted in each case.

Step 15 generates one or more transfer functions, preferably sums of Chebyshev polynomials, for each frame of harmonic data; and step 17 stores the transfer functions in an appropriate digital form, correlatable with the original samples of recorded sound, for later use in real-time method 20. It is sufficient to store the coefficients of the added Chebyshev polynomials. The coefficients can then be read into short-term memory for evaluation of the full polynomial transfer function, as needed by the interpolation process.

In FIG. 1B, real-time method 20 comprises a synthesis process initiated by a command to initiate synthesis, which is illustratively provided to the computer in the form of a floating point position having parameters within the ranges of those in the transfer function table. The following steps are executed by the computer. In step 22, the floating-point position is split between an address portion and an interpolation constant B. If the transition to this position is a nonlinear transition, the endpoints are specified as integer addresses, and the floating-point position between them provides the interpolation constant B. In optional step 24, used only if an integer position address has changed, the computer reads polynomial coefficients into short-term memory, starting from the nearest positions stored in the transfer function table, and evaluates the full polynomial transfer functions. Step 26 supplies driving waves corresponding to the synthesis command to Step 28.

Step 28 uses an input value from the driving wave to derive position and linear interpolation constant A from two parallel lookup functions. The two parallel lookup functions represent the two adjacent integer positions sought by the program in the data table in memory with respect to the input floating point or real number position. The values found at the two adjacent integer positions form the basis for the interpolation. Thus, the step 30 looks up (reads) adjacent values in waveshape (the transfer function) tables, and interpolates between those values according to interpolation constant A. The interpolation occurs in real time and realizes a fractional position that, when converted to the time domain, will correspond to the desired intermediate sound property.

The input value of the driving wave of step 26 is carried all the way through steps 28–32 and, in step 34, excites a reconversion to a signal representing the selected spectra, as interpolated, in the time domain. The resulting analog time domain signal is applied to a speaker to generate sound. The synthesis process just described assumes that a linear transition is called for. When a nonlinear transition is called for, the constant B is obtained per steps 22 and 24, and step 32 looks up (reads) adjacent values among the stored transfer functions and interpolates between them according to constant B. In either the case of a linear transition or a nonlinear transition, interpolation occurs by a combination of the data in two parallel data channels, as will become clearer hereinafter. A nonlinear transition, in particular, may be called for when interpolating for an intermediate sound volume level, to take account of the response characteristic of the human ear. Different sequences of transfer functions are preferred for different frequency bands. Interpolations with respect to harmonics to obtain an intermediate timbre would have still another characteristic.

Figure 1C:
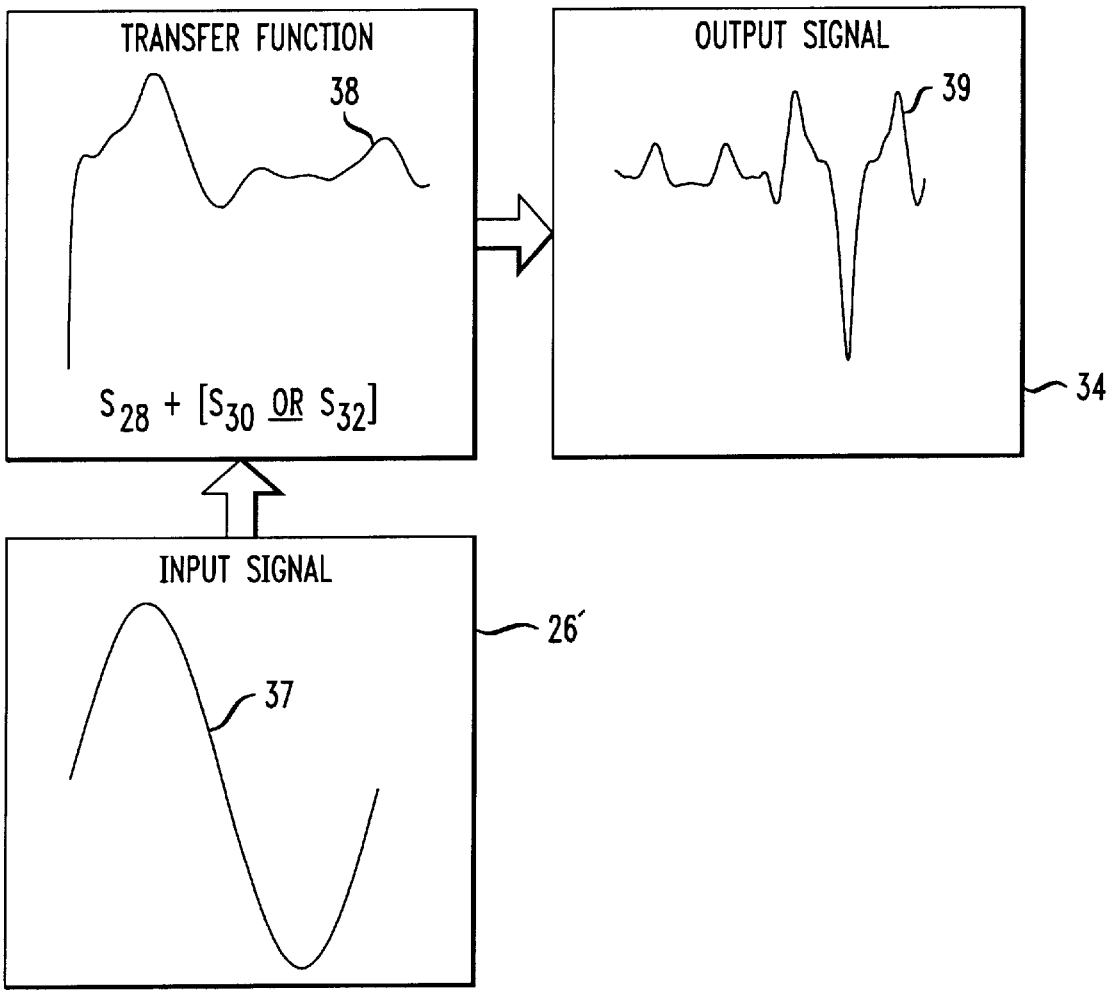
FIG. 1C shows a flow diagram highlighting further details of FIG. 1B.

FIG. 1C highlights further details of the operation of the central steps of the method of FIG. 1B. Step 26' is a specific case of step 26 of FIG. 1B, in which a sinusoidal wave 37 is supplied to step 28 and, from there causes the operation of step 30 or 32. The evaluated, interpolated transfer function 38 is the result, which is applied to step 34 to produce output time domain signal 39.

Either interpolating step 30 or 32, in its simplest form, provides an output with at least one median property with respect to a pair of input transfer functions. With respect to that one property, interpolation has occurred. One appropriate interpolation step for Chebyshev polynomial coefficients in digital form is provided, in part, by the action of the interpolation block of FIG. 4. As will become clearer hereinafter from the description of FIG. 3, however, numerous other surrounding pieces of gear must take account of, and have properties corresponding to, the properties of the interpolation block of FIG. 4. Thus, the actions of apparatus surrounding each interpolation block are also part of interpolation step 28 or interpolation step 30.

The operation of the implementation of the method of FIG. 1B provides a sound output, as determined by the interpolation between stored transfer functions, that has, for example, an intermediate balance of higher harmonics that not only sounds natural, but also may not be achievable by any available instrument. Further, this result is achieved in a cost-effective way without the extensive electronic memory requirements of some electronic musical instruments using Wavesample wave synthesis and without the nearly prohibitive calculation costs of currently proposed additive synthesis techniques.

The key to these advantages lies in three aspects of the current technique. These advantages are (1) the pre-calculation of the transfer functions, (2) the efficiency of interpolation between transfer functions as a way of interpolating between complex harmonic data, and (3) the predictability of using Chebyshev polynomial-based transfer functions. The latter advantage rests on the fact that each polynomial order produces a specific harmonic of an incoming (exciting) sinusoid from driving wave step 26.

Advantageously, the method of the present invention, while providing intermediate properties between two recorded sounds, can be further augmented. For additional richness of sound, the method may readily add to interpolated sound additional higher harmonic frequencies and anharmonic frequencies. In this way, the present invention can be married with existing additive wave synthesis techniques, while retaining a more natural sound. The output of the method can be combined with short sampled sounds for the reproduction of short-time-scale transients difficult to reproduce as harmonic spectra.

Modifications of the method of FIG. 1B are described hereinafter with reference to the flow diagrams of FIGS. 6A, 6B, and 6C.

According to another aspect of the invention, an electronic data processing apparatus provides efficient sound-sample-derived additive synthesis. The apparatus can employ the same pre-calculated transfer functions as the method of the invention. A preferred implementation of the electronic data processing apparatus, which also implements the real-time method of the invention, is described with reference to FIGS. 2–5.

Figure 3:
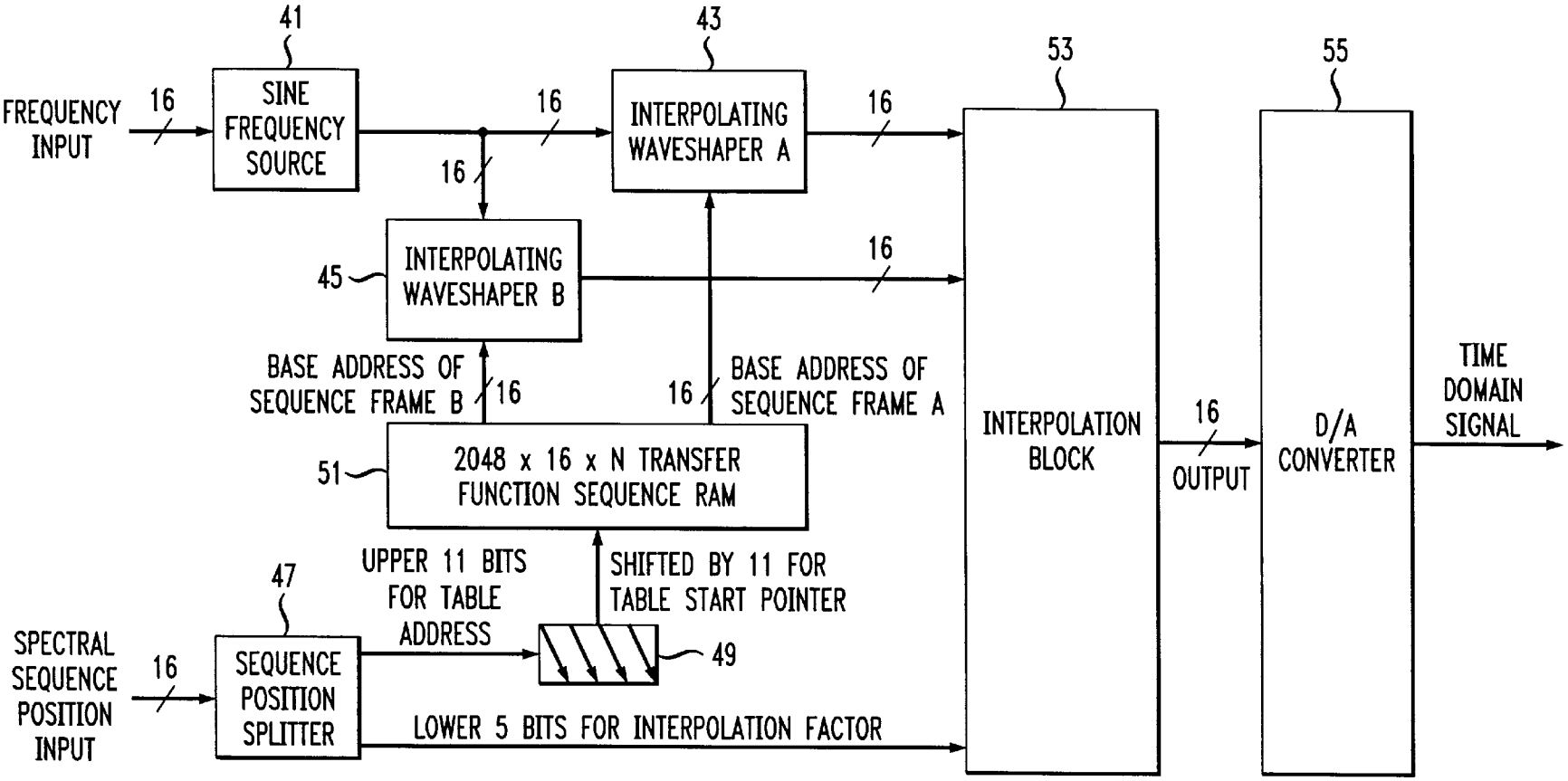
FIG. 3 shows a block diagrammatic illustration of an electronic data processing system according to the invention.

The overall organization of the electronic data processing apparatus is shown in FIG. 3. An important repeated component of FIG. 3 is an interpolation block, such as interpolation block 53, which appears at its output. Like interpolation blocks, i.e., block 93 (see FIG. 5), also appear in sine frequency source 41, as well as in the A channel interpolating waveshaper 43, and in the B channel interpolating waveshaper 45.

Figure 2:
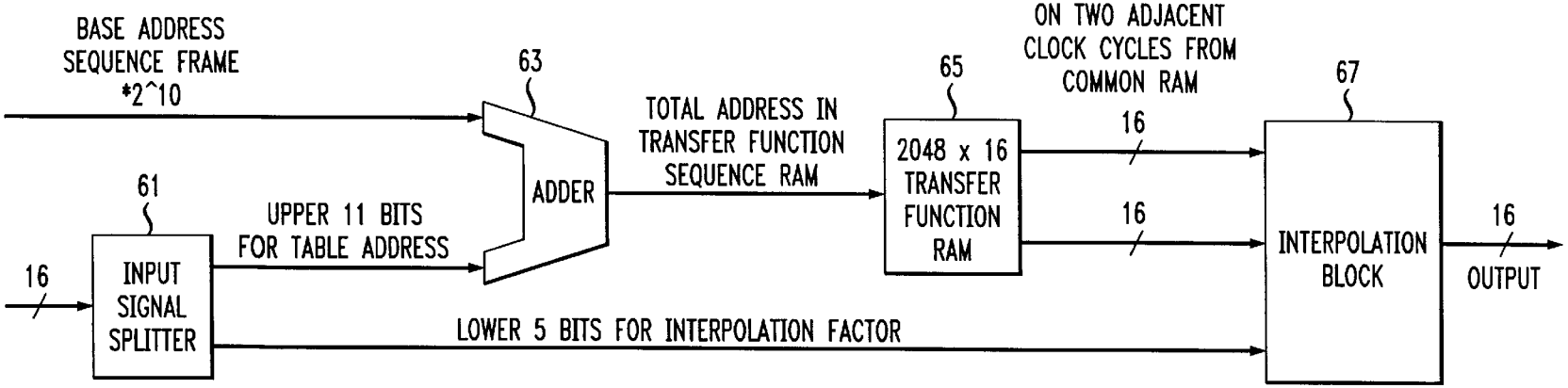
FIG. 2 shows a block diagrammatic illustration of an interpolating waveshaper for an electronic data processing system according to the invention.

FIG. 2 shows the configuration of each of these interpolating waveshapers; and each shows an interpolation block 67 at its output.

Figure 4:
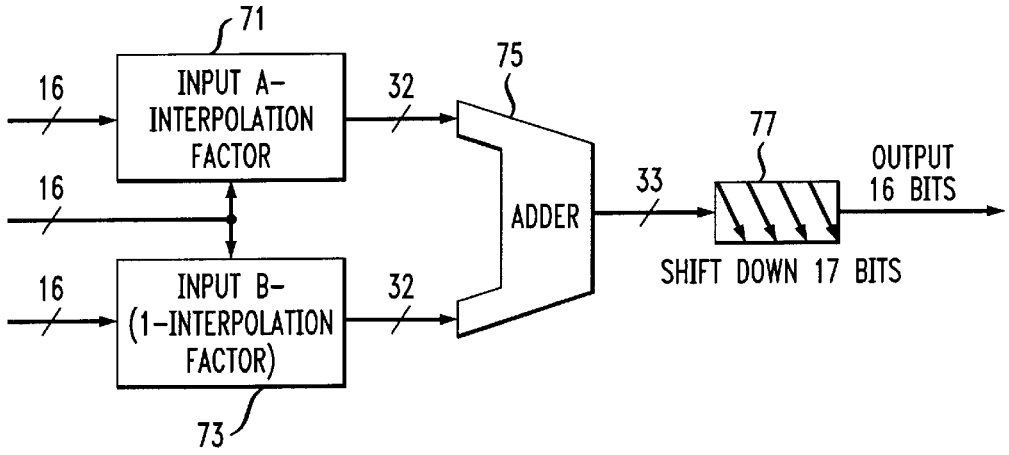
FIG. 4 shows a block diagrammatic illustration of an interpolation block illustratively used in the showings of FIGS. 2, 3, and 5.

Accordingly, FIG. 4 shows the typical arrangement of an interpolation block. It includes an input A logic circuit 71 applying an interpolation factor to its two 16-bit input signals and an input B logic circuit 73 multiplying its two 16-bit input signals by (1—the interpolation factor). Then, the output signals of logic circuits 71 and 73 are 32-bit signals of appropriate scale to added interpolatively in adder 75. The downshifter 77 downshifts the 33-bit output signal of adder 77 by 17 bits to provide an output 16-bit signal. It will be seen that whether the inputs to the interpolation block come from a sine table ROM 91, as for interpolation block 93 in FIG. 5, or from a transfer function RAM 65 as for interpolation block 67 in FIG. 2, or from interpolating waveshapers 43 and 45 as for interpolation block 53 in FIG. 3, the functions are the same. Each interpolation block corresponds to, and takes account of the needs of, the next down-stream interpolation block.

In FIG. 3, sine frequency source 41 supplies a signal representing a sine frequency excitation wave to parallel interpolating waveshapers 43 and 45,which are also supplied with respective transfer function sequences from transfer function sequence RAM 51. These transfer function sequences are selected from RAM 51 by sequence position splitter 47in response to a spectral sequence position input. Sequence position splitter 47 applies the upper 10 bits for table address to downshifter 49, which shifts by 11 positions to obtain the table start pointer. The lower 5 bits from sequence position splitter 47 are applied directly to interpolation block 53 to determine the interpolation factor. A digital-to-analog converter 55 is connected to the output of interpolation block 53 to yield the synthesized time-domain signal. A speaker (not shown) converts the latter to sound.

Interpolating waveshapers 43 and 45 of FIG. 3 are preferably constructed as shown in FIG. 2. The respective base address output of 2048•16•N transfer function sequence RAM is applied to the upper input of adder 63. Input signal splitter 61 supplies the upper 11 bits for table address to the lower input of adder 63, which then supplies a total address for 2048•16 transfer function RAM 65, which then supplies dual signal outputs to interpolation block 67. The output of interpolation block 67 for each waveshaper 43 and 45 is then applied to interpolation block 53 of FIG. 3. It is noted that the size of transfer function RAM 65 is selectable in that increasing the size of the table reduces the required interpolation.

Figure 5:
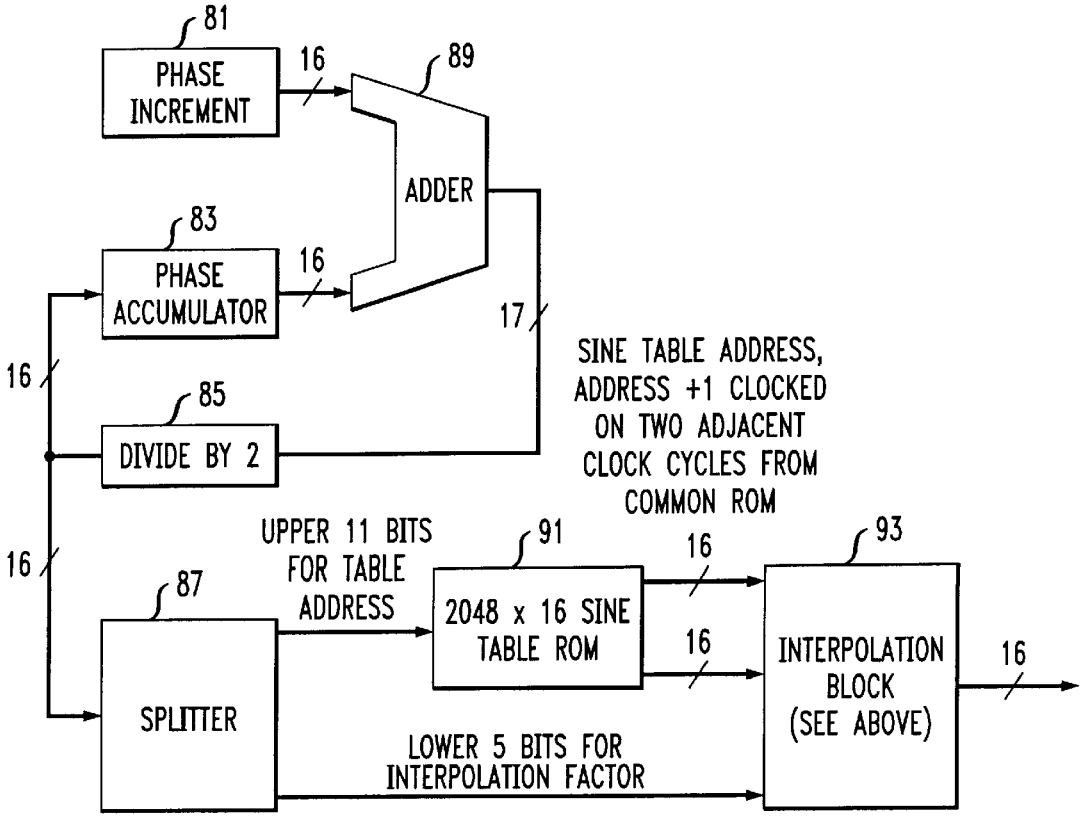
FIG. 5 shows a block diagrammatic illustration of a sine frequency source used in the embodiment of FIG. 3.

A preferred configuration of sine frequency source 41 of FIG. 3 is shown in FIG. 5. Phase increment source 81 and phase accumulator 83 of FIG. 5 apply signals to respective inputs of adder 89. Divider 85 divides the 17-bit signal from adder 89 by two and applies 16-bit signals to phase accumulator 83 and splitter 87. Splitter 87 applies the upper 11 bits for table address to 2048•16 sine table ROM 91 and the lower 5 bits for interpolation factor to interpolation block 93. Sine table ROM 91 provides dual outputs in that the sine table address, and the sine table address +1 are clocked on two adjacent clock cycles from the common ROM. The method of FIG. 1B and the apparatus of FIG. 3, however, do not require the use of source 41. Useful substitutions comprise sources 111 and 121 in FIG. 6B and FIG. 6C, respectively, which will be described hereinafter.

The overall functions of the electronic data processing apparatus as arranged in FIG. 3 and further detailed in FIGS. 2, 4, and 5 are as described above for FIG. 1B.

Figure 6A:
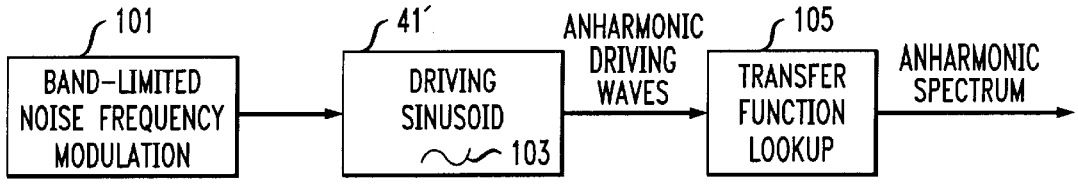
FIG. 6A shows a block diagram of a first arrangement for producing anharmonic waves useful in practicing the invention.

FIG. 6A illustrates that anharmonic driving waves can be obtained for use according to the invention by frequency-modulating a single sinusoid 103 in modified source 41' by a band-limited noise signal from modulating source 101. The resulting anharmonic driving waves trigger transfer function lookup 105, e.g., by apparatus 47, 49, and 51 of FIG. 3, which in turn yields anharmonic spectra. This technique is also useful for producing sibilants when using the invention of FIG. 1 and/or FIG. 3 for speech synthesis.

Figure 6B:
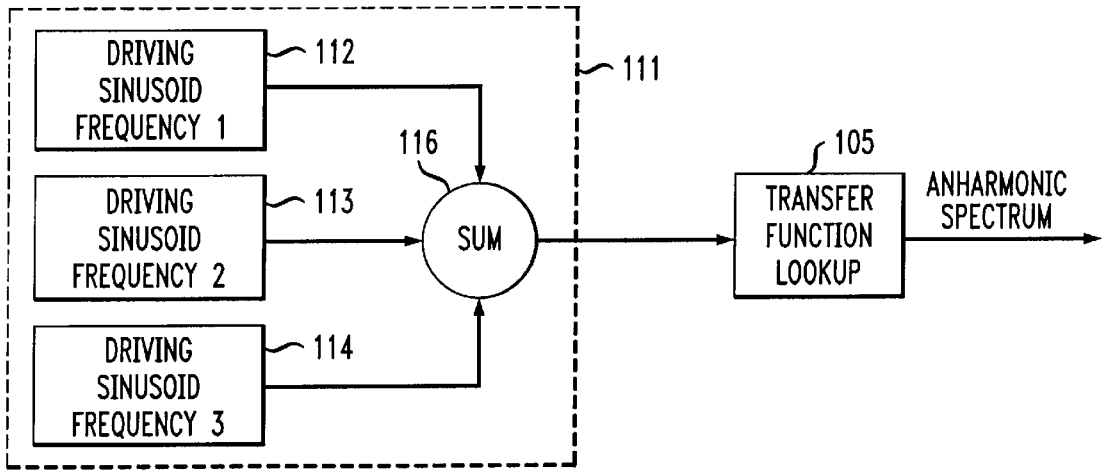
FIG. 6B shows a block diagram of a second, multiple-frequency arrangement for producing anharmonic waves useful in practicing the invention.
Figure 6C:
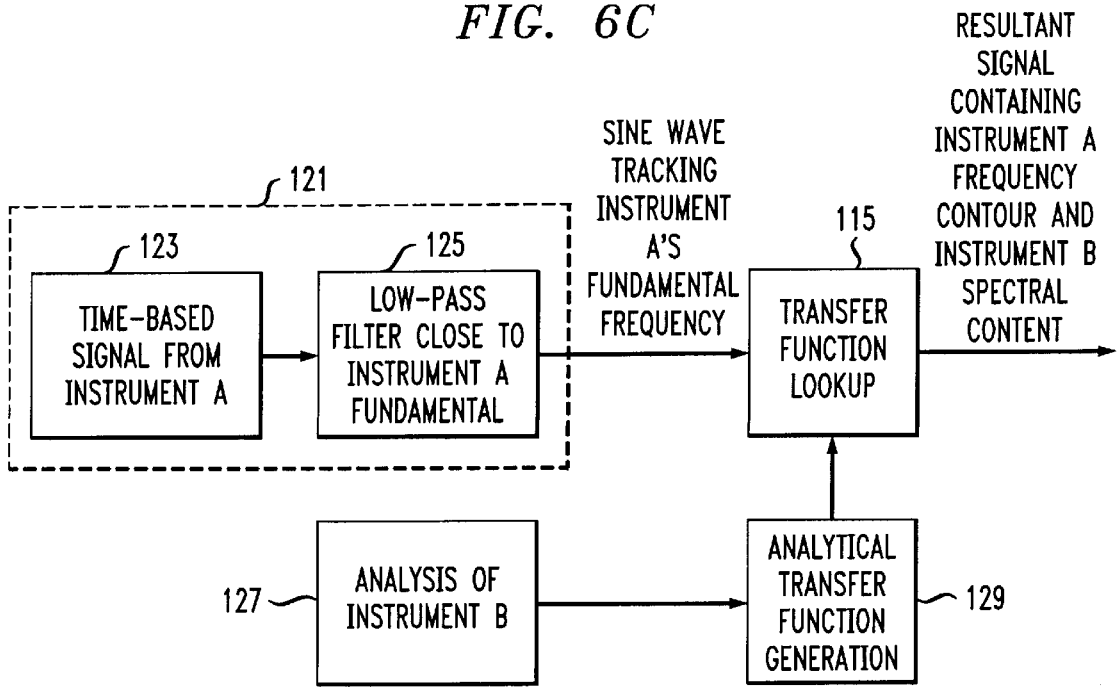
FIG. 6C shows a third, sound-transduced, external-frequency arrangement for producing anharmonic waves useful in practicing the invention.

FIGS. 6B and 6C illustrate the use of frequency sources that may be external to the digital electronics of FIG. 33. In FIG. 6B, multiple driving sinusoids are provided by source 111, which includes sources 112, 113, and 114 of differing frequencies. These frequencies are summed by summing circuit 116 and applied to transfer function lookup.105'.

In FIG. 6*c*, source 121 includes a source of a time-based signal derived from an instrument A (not shown) and a low-pass filter 125 passing only a narrow band of frequencies close to the fundamental frequency of instrument A. The output of source 121 is applied to transfer function lookup 115, which can be like 105 above or can be like that described below in FIG. 8. Apparatus 127 providing analysis of instrument B, the sound of which is to be synthesized, and apparatus 129 providing analytical transfer function generation can operate as in FIG. 1A, or can be configured and function according to techniques well known in the art. The use of external frequency source 121 allows the fundamental frequency of instrument A to drive the synthesized harmonics of instrument B.

Figure 7A:
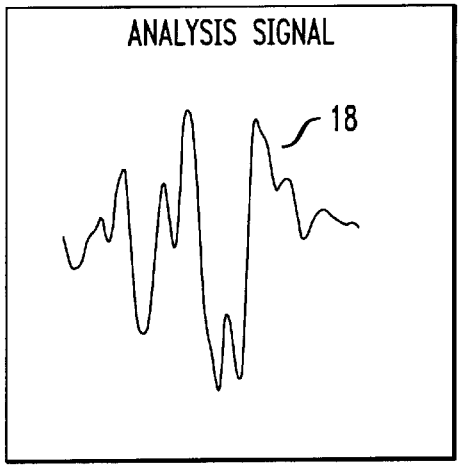
FIGS. 7A and 7B show curves relevant to the operation of the method of FIG. 1A.
Figure 7D:
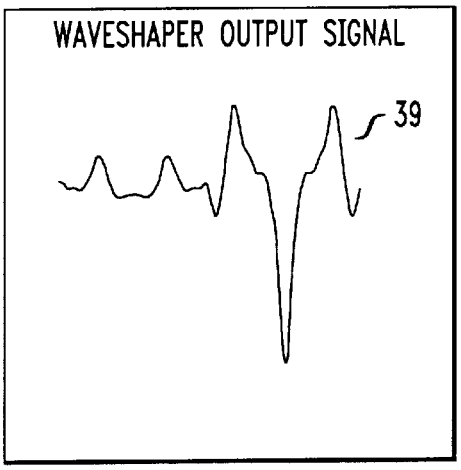
FIGS. 7C and 7D show curves relevant to the operation of the method of FIG. 1B and the operation of the system of FIG. 3.
Figure 7B:
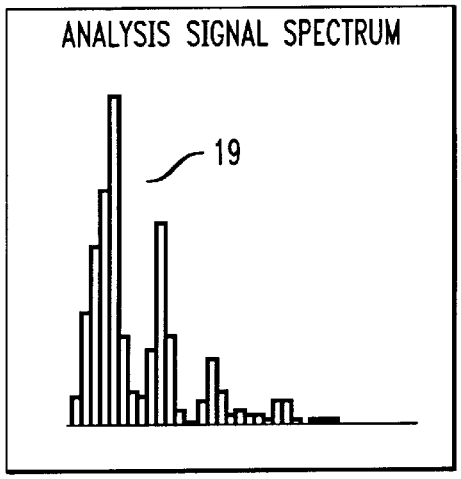
Figure 7C:
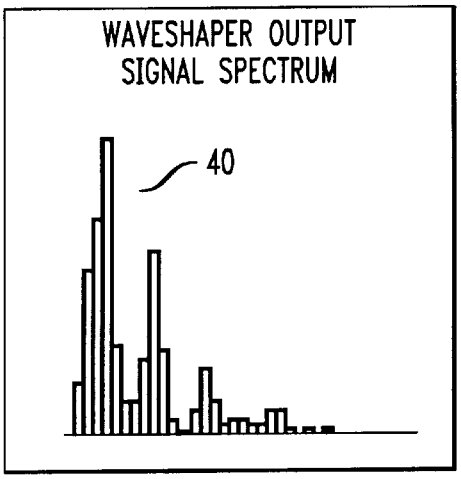

FIGS. 7A–7D provide some instructive comparisons between the samples and spectra available before the operation of the invention and those available after the operation of the invention. FIG. 7A shows one electronic time-domain signal corresponding to one sample or frame of recorded sound. Curve 19 shows an analysis spectrum of that signal. Curve 19 yields transfer function 38 of FIG. 1C. The coefficients of transfer function 38 are stored, for example, in RAM 51 of FIG. 3. The adjacent stored coefficients would presumably correspond to signals and spectra differing only in specific properties, e.g., harmonics, from those of signal 18 and spectrum 19. After the selected transfer functions are processed by interpolating waveshapers 43 and 45 and interpolation block 51 of FIG. 3, the waveshaper output time-domain signal 39 results. The latter signal corresponds to an output signal spectrum 40 of FIG. 7C. The differences between signals 18 and 39 and between spectra 19 and 40 are consequences of the selected other input or inputs for interpolation according to the invention.

Figure 8:
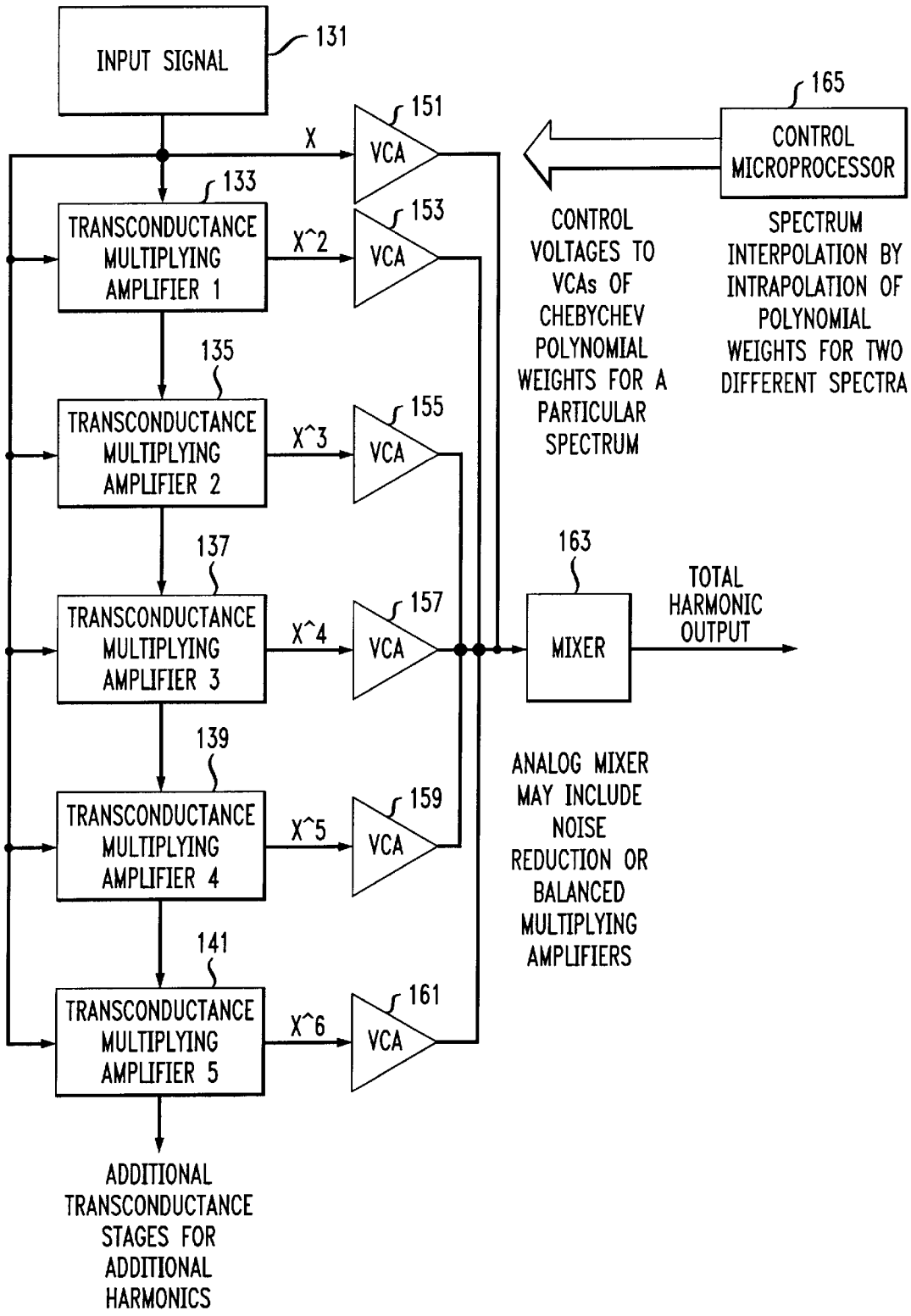
FIG. 8 shows a block diagram of an implementation of the method of FIG. 1B employing analog Chebyshev polynomial lookup.

The implementation of FIG. 8 provides an alternative to the implementation of FIGS. 2–5, which are intended to be digital. In contrast, the implementation of FIG. 8 can be completely analog, except perhaps control microprocessor 165.

In FIG. 8, an input signal from source 131 is applied to transconductance multiplying amplifiers 133 to 141, generating individual harmonics. Their amplitudes are set by voltage-controlled amplifiers 151–161, which respond to microprocessor 165 according to the Chebyshev polynomial weights for a particular spectrum to be synthesized. The microprocessor 165 determines spectrum interpolation by interpolation of polynomial weights for two different spectra. The outputs of voltage-controlled amplifiers 151–161 are applied to analog mixer 165, which may include noise reduction or balanced multiplying amplifiers.

Figure 9:
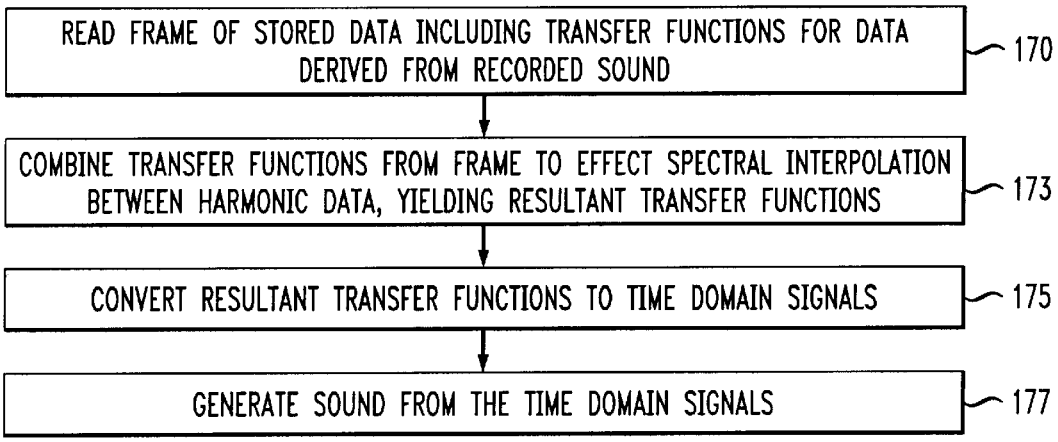
FIGS. 9 and 10 are flow diagrams summarizing methods according to the invention.

FIG. 9 summarizes the basic method of the invention. In the flow diagram, step 170 reads a frame of stored data including transfer functions representing data derived from recorded sound. Step 173 combines transfer functions from the frame of stored data to effect spectral interpolation between harmonic data, yielding resultant transfer functions. Step 175 converts the resultant transfer functions to time domain signals, and step 177 generates sound from the time domain signals.

Figure 10:
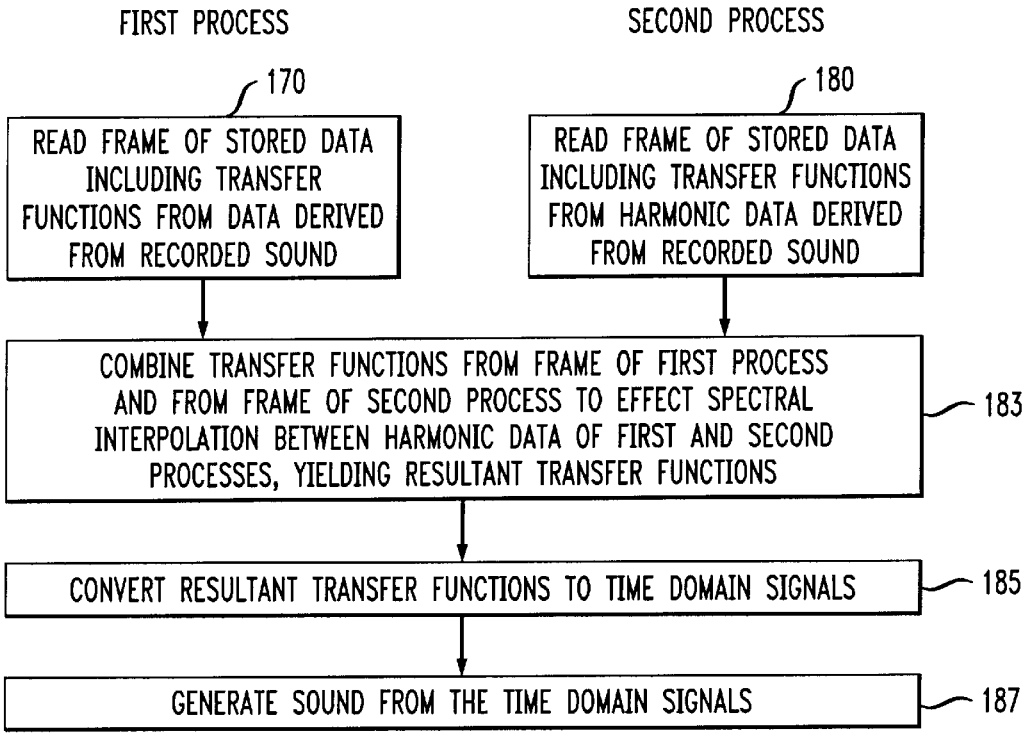

The flow diagram of FIG. 10 shows a modification of the method of FIG. 9. A first process is like that of FIG. 9, in that it includes reading step 170. Combining step 183 follows reading step 170. Combining step 183 is followed by converting step 185 and generating step 187, respectively like steps 175 and 177 of FIG. 9. A second process includes reading step 180 in parallel with reading step 170. Reading step 180 reads a frame of stored data that includes transfer functions representing harmonic data derived from actual sounds. Combining step 183 combines the transfer functions from the respective frames read in the first and second processes to effect spectral interpolation between harmonic data represented in the first and second processes, yielding corresponding resultant transfer functions. Step 185 converts the corresponding resultant transfer functions to time domain signals, and step 187 generates sound from the time domain signals.

It should be understood that the techniques and arrangement of the present invention can be varied significantly without departing from the principles of the invention as explained above and claimed hereinafter.

What is claimed is:

1. A method of sound synthesis, comprising the steps of:

reading a frame of stored data that include transfer functions representing data derived from recorded sounds;

combining the transfer functions from the frame of stored data to effect spectral interpolation between harmonic data, yielding resultant transfer functions;

converting the resultant transfer functions to time domain signals; and generating sounds from the time domain signals.

2. The method according to claim 1, wherein the reading, combining, and converting steps occur in a first process, the method further comprising in a second process conducted at least partially in parallel with the first process, the steps of:

reading a frame of stored data that include transfer function representing harmonic data derived from actual sounds;

combining transfer functions from the respective frames of stored data of the first and second processes to effect spectral interpolation between harmonic data represented in the respective first and second processes, yielding corresponding resultant transfer functions; and converting the corresponding resultant transfer function to corresponding time domain signals, whereby the sound generating step generates sound from the corresponding time domain signals.

3. The method according to claim 2, wherein the reading steps of the first and second processes read transfer functions representing harmonic data having differing timbre, whereby the sound generating step yields timbre morphing.

4. The method according to claim 3, wherein the stored transfer functions include Chebyshev polynomial-based transfer functions having selected ranges of coefficients and representing recorded sounds of musical instruments having different timbres according to the ranges of coefficients.

5. The method according to claim 2, wherein the stored transfer functions include Chebyshev polynomial-based transfer functions.

6. The method according to claim 2, wherein the converting step is driven at least in part by a plurality of waves that are not harmonically related.

7. The method according to claim 2, wherein the converting steps of the first and second processes are driven by respective waves that are modulated by respective band-limited noise signals.

8. The method according to claim 1, wherein the stored transfer functions include Chebyshev polynomial-based transfer functions.

9. The method according to claim 1, wherein the stored transfer functions include Chebyshev polynomial-based transfer functions having selected ranges of coefficients and representing recorded sounds of musical instruments having different timbres according to the ranges of coefficients.

10. The method according to claim 1, wherein the converting step includes modulating a band-limited noise signal on a sinusoidal excitation wave.

11. The method according to claim 1, wherein the stored transfer functions are represented by the coefficients of Chebyshev polynomials and wherein the reading step comprises the step of reading the coefficients into short-term memory as needed by the interpolation process and then evaluating the Chebyshev polynomials.

12. The method according to claim 11, wherein the step of reading the coefficients into short-term memory as needed comprises the step of reading the coefficients into short-term memory when an integer address value is changed.

13. The method according to claim 1, wherein the reading step comprises reading a frame of stored data that include transfer functions representing data derived from recorded sounds of a first musical instrument.

14. The method according to claim 13, wherein the step of converting the resultant transfer functions to time domain signals comprises the step filtering a waveform derived from a second musical instrument to a band close to its fundamental frequency and applying the filtered waveform to convert the resultant transfer functions interpolated from the transfer functions representing the data derived from recorded sounds of the first musical instrument.

15. The method according to claim 1, wherein the step of converting the resultant transfer functions to time domain signals comprises the step filtering a waveform derived from an external sound source to a band close to its fundamental frequency and applying the filtered waveform to convert the resultant transfer functions.

16. An electronic data processing system for additive sound synthesis, comprising:

an electronic memory storing a plurality of frames of data that include transfer functions representing harmonic data derived from recorded sounds;

a transfer function reader for reading from the memory a sequence of transfer functions;

apparatus for combining sequences of transfer functions to effect spectral interpolation between harmonic data, yielding resultant transfer functions;

excitation apparatus for converting the combined sequences of transfer functions to time domain signals; and a speaker for generating sound from the time domain signals.

17. The electronic data processing system according to claim 16, wherein the transfer function reader comprises a portion of a first synthesis channel, the system further comprising a second synthesis channel in parallel with the first synthesis channel, the second synthesis channel including:

apparatus for reading sequences of transfer functions from the memory and furnishing them in the second channel, whereby the apparatus for combining sequences of transfer functions effects spectral interpolation between harmonic data by interpolation between transfer functions respectively in the first and second synthesis channels, yielding corresponding resultant sequences of transfer functions input to the excitation apparatus.

18. The electronic data processing apparatus according to claim 17, wherein the transfer function reader and the apparatus for reading sequences of transfer functions from the memory and furnishing them in the second channel respectively read sequences of transfer functions representing harmonic data having differing timbre, whereby the sound generating step yields timbre morphing.

19. The electronic data processing apparatus according to claim 18, wherein the stored transfer functions include Chebyshev polynomial-based transfer functions having selected ranges of coefficients and representing recorded sounds of musical instruments having different timbres according to the ranges of coefficients, and wherein the transfer function reader and the apparatus for reading sequences of transfer functions from the memory and furnishing them in the second channel respectively read sequences of transfer functions representing harmonic data having differing timbre, whereby the excitation apparatus and the speaker produce output sound having timbre morphing.

20. The electronic data processing apparatus according to claim 17, wherein the stored transfer functions include Chebyshev polynomial-based transfer functions.

21. The electronic data processing apparatus according to claim 17, wherein the excitation apparatus includes means for generating waves that are not harmonically related.

22. The electronic data processing apparatus according to claim 17, wherein the excitation apparatus includes means for modulating at least one sinusoidal wave by a band-limited noise signal.

23. The electronic data processing apparatus according to claim 16, wherein the stored transfer functions include Chebyshev polynomial-based transfer functions.

24. The electronic data processing apparatus according to claim 16, wherein the stored transfer functions include Chebyshev polynomial-based transfer functions having selected ranges of coefficients and representing recorded sounds of musical instruments having different timbres according to the ranges of coefficients.

25. The electronic data processing apparatus according to claim 16, wherein the excitation apparatus includes means for modulating a band-limited noise signal on a sinusoidal wave to produce excitation waves.

26. The electronic data processing apparatus according to claim 16, wherein the excitation apparatus includes means for generating a plurality of waves that, at least in part, are not harmonically related.

27. The electronic data processing system according to claim 16, wherein the excitation apparatus for converting the combined sequences of transfer functions to time domain signals comprises an analog apparatus.

* * * * *